US005588241A

United States Patent [19]

Hurley

[11] Patent Number: 5,588,241

[45] Date of Patent: Dec. 31, 1996

[54] HIGH CAPACITY CONVERSION MAGAZINE

[76] Inventor: William W. Hurley, Temple Main Post Office, 401 N. Main, Temple, Tex. 76501

[21] Appl. No.: 484,239

[22] Filed: Feb. 26, 1990

[51] Int. Cl.[6] ..... F41A 9/65

[52] U.S. Cl. ..... 42/50; 42/18

[58] Field of Search ..... 42/6, 18, 22, 49.01, 42/49.02, 50; 89/33.01, 33.1, 138

[56] References Cited

U.S. PATENT DOCUMENTS

| | | | |
|---|---|---|---|
| 1,089,195 | 3/1914 | Falco | 89/138 |
| 1,743,472 | 1/1930 | Meyer | 89/138 |
| 2,081,235 | 5/1937 | Hillyard | 42/50 |
| 4,428,137 | 1/1984 | Johnson | 42/50 |
| 4,580,364 | 4/1986 | Vyprachticky | 42/50 |

*Primary Examiner*—Michael J. Carone
*Attorney, Agent, or Firm*—Richards, Medlock & Andrews

[57] ABSTRACT

An interchangeable high capacity rifle magazine with an integral bolt stop assembly is disclosed. The magazine can be used with the Soviet 7.62×39 Simonov (SKS) rifle and for the Chinese copy, the Type 56 series rifles and carbines, and for all other copies thereof.

3 Claims, 2 Drawing Sheets

HIGH CAPACITY CONVERSION MAGAZINE

FIELD OF THE INVENTION

This invention relates to firearms, and particularly to a magazine conversion to increase the effectiveness of an existing firearm design.

BACKGROUND OF THE INVENTION

Often, a military or sporting firearm will be considered obsolete due to the absence of a desired feature, or the poor design or inconvenience of using a feature of the firearm, rather than with the basic firearm design itself. One example of note is the series of communist block rifles including the Soviet 7.62×39 Simonov (SKS) rifle and the Chinese copy, the Type 56 series rifle and carbine. These firearms have lost favor among military, and even civilian applications because the firearm has an internal magazine design which contains a limited number of cartridges. Further, the design is difficult to load and also difficult to unload to place the firearm in a safe condition.

SUMMARY OF THE INVENTION

The present invention relates to an interchangeable high capacity rifle magazine with integral bolt stop assembly for the Soviet 7.62×39 Simonov (SKS) rifle and for the Chinese copy, the Type 56 series rifles and carbines, and for all other copies thereof. This magazine is composed of a magazine body which incorporates a new design (shape and size) not previously used. It also incorporates a newly designed integral bolt stop assembly not previously used, a newly designed follower with integral bolt stop assembly not previously used, a magazine spring, magazine spring retainer and magazine spring floorplate.

BRIEF DESCRIPTION OF THE DRAWINGS

Further objects and advantages of the invention will become more apparent from the Detailed Description and Claims, and from the accompanying drawings, wherein:

DETAILED DESCRIPTION

Details of the invention will become apparent from the following specifications and drawings, in which the invention will be described and explained in greater detail, reference being made by way of example in the accompanying drawings. The features apparent from the specifications and drawings may be applied separately or in any combination desired.

Figure 1:
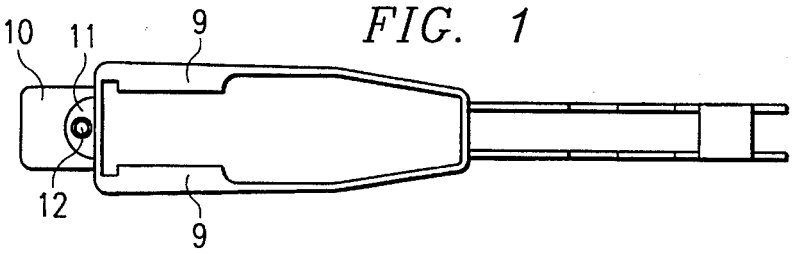
FIG. 1 is a view of the top of the magazine without the follower as it is shown in greater detail in other figures.
Figure 2:
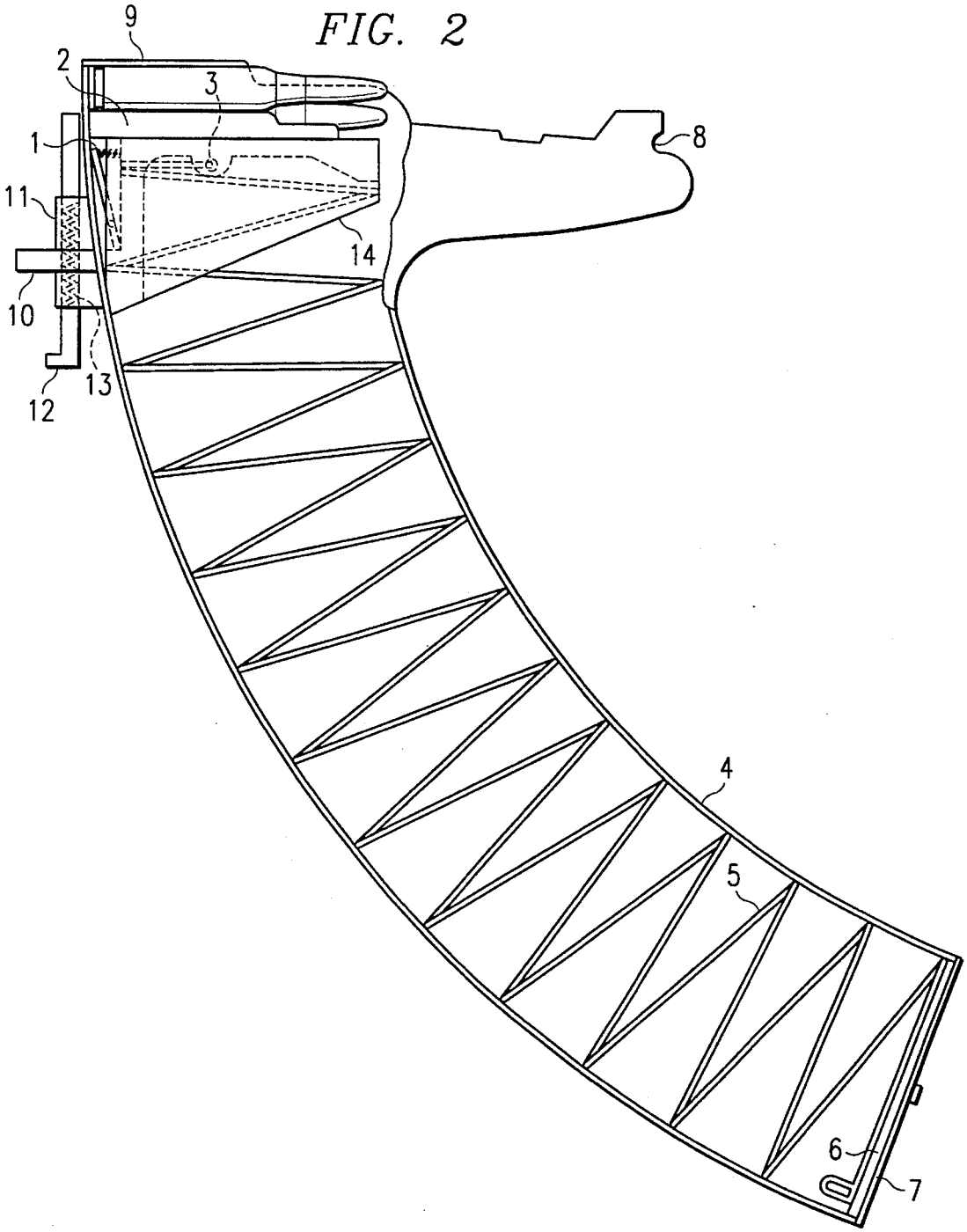
FIG. 2 is a sectioned view of the magazine body with all components shown.
Figure 3:
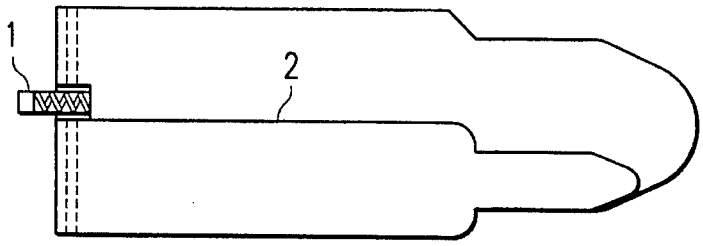
FIG. 3 is a top view of the follower with integral bolt stop assembly.

The magazine shown in FIG. 2 consists of five basic components and two assemblies. The five basic components are the magazine body 4, the follower body 14, the twenty-five loop standard magazine spring 5, the magazine spring retainer 6 and the magazine floorplate 7. The two assemblies are contained in the follower body 14 and in the bolt stop housing 11. The assembly contained in the follower body 14 consists of the bolt stop, bolt stop pin and bolt stop spring and are shown as 1. The assembly contained in the bolt stop housing 11 consists of the bolt stop plunger 12 and the bolt stop plunger spring 13.

Figure 4:
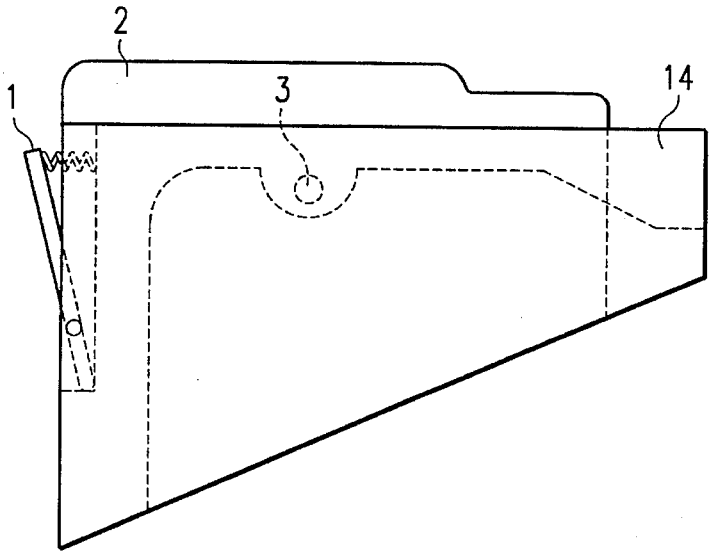
FIG. 4 is a left side view of the follower with integral bolt stop assembly.
Figure 5:
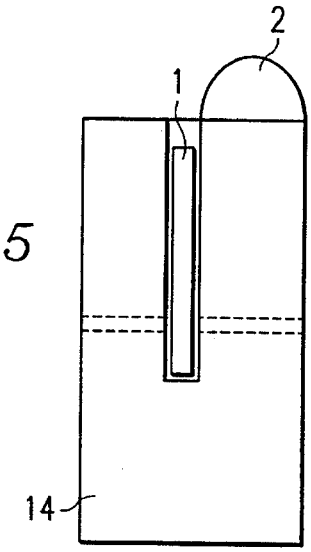
FIG. 5 is a rear view of the follower with integral bolt stop assembly.

Additionally and referencing FIG. 2, the mode of operation requires that if a magazine is loaded by hand, a rifle round must be inserted into the magazine 4 by placing the rifle round on top of the follower body 14 and just in front of the magazine lips 9 with the base of the rifle round facing the rearmost portion of the magazine body 4. With the rifle round in this position, it is then pressed downward and towards the rear of the magazine body 4 at the same time coming to rest at the rear of the magazine body 4 and being held in place by the magazine lip 9. Each round would then be loaded in the same manner when loading by hand. As each rifle round is loaded into the magazine 4 the follower body 14 is moved downward, compressing the magazine spring 5. Upon loading the first round, the downward movement of the follower body 14 will cause the follower body integral bolt stop (FIG. 4 #1) to compress into the follower body 14, thus disengaging it from the rifle's internal bolt holding open component. As each following round is loaded into the magazine, the follower body 14 moves downward until all 40 rounds have been loaded, or until the desired number of rounds have been loaded.

The magazine 4 may be loaded in four different ways.

a. Removed from the rifle and loaded by hand each round separately.

b. Removed from the rifle and loaded with a magazine loader using ten round stripper clips or chargers.

c. In the rifle and loaded by hand each round separately.

d. In the rifle and loaded with ten round stripper clips or chargers.

When loaded in the rifle and using ten round stripper clips as mentioned in d. above, you would lock the bolt to the rear by engaging the integral bolt stop plunger 12 of the magazine 4 and inserting one end of the stripper clip or charger into the charger guide which is machined into the top forward end of the bolt carrier of the rifle. You would then take your thumb and push firmly downward on the top round of the ten rounds pressing firmly until all ten rounds are in the magazine 4 itself. You would then remove the stripper clip or charger from the charger guide of the rifle and discard it. You would do this four times to reach the maximum number of rounds in the magazine 4 for a total of forty rounds.

Additionally and referencing FIG. 2, during the loading cycle the following takes place.

a. The rifle's bolt and bolt carrier move forward allowing the rifle's bolt feed rib to grasp the round being held by the magazine lips 9 and moving forward strips the round from under the magazine lips 9 and proceeds to chamber it for firing.

b. A fresh round is then pushed upward in the magazine 4 as it rides on top of the follower body 14 as the follower body 14 is pushed upward by the expanding power of the magazine spring 5.

c. As the last round remaining in the magazine 4 is stripped from the magazine 4, the integral bolt stop (FIG. 4 #1) in the follower body 14 will activate by being forced outward into an opening prepared for it and as it does so, and while moving upward at the same time, will activate the rifle's internal bolt holding open device thereby causing the rifle's bolt to remain to the rear when the last shot is fired, and leaving the rifle's action open for reloading either by hand or by use of stripper clips or chargers.

The purpose of the integral bolt stop assembly (FIG. 2) 11, 12, 13 incorporated in the magazine body 4 is to allow the operator of the rifle to interrupt the cycle of firing at any given point to reload the rifle as necessary. This is accomplished by the operator placing the fingers of the left hand (if right handed) around the magazine body 4 and the left thumb in line with and just below the bolt stop plunger 12 which is being held in a downward position by the power of the bolt stop plunger spring 13. The operator would then take their right hand with the palm up and pull the rifle's bolt to the rear. With the bolt to the rear and while holding it in this position, the operator would then press upward with the thumb of the left hand, applying pressure to the bolt stop plunger 12 and thereby activating the bolt stop plunger 12 which in turn activates the rifle's internal bolt holding open device which is a part of the rifle itself. When the operator removes the right hand from the rifle's bolt, the bolt is now held open by the rifle's internal bolt holding open device and the rifle is now ready to either be reloaded or the operator may remove the magazine 4 from the rifle at this time by activating the rifle's magazine catch assembly.

The magazine (FIG. 2 #4) may be disassembled by removing the magazine floor plate 7 and pulling out the magazine spring retainer 6 which is attached directly to the magazine spring 5. You would then remove the follower body 14 to which the magazine spring 5 is attached by means of a follower spring attachment loop 3. The magazine 4 can be reassembled in the reverse order.

The forward locking notch (FIG. 2 #8) is used to lock the magazine 4 into the rifle. Holding the rifle in the left hand with the bolt locked to the rear, you would take the magazine in your right hand and, with the forward locking notch facing the muzzle end of the rifle, place the forward end of the magazine into the magazine well of the rifle at approximately a 45 degree angle. While holding the magazine at a 45 degree angle, insert the magazine 4 into the rifle's magazine well until the forward locking notch comes into contact with a projection that is part of the barrel of the rifle and is used to hold the magazine currently in use. With the forward locking notch 8 firmly engaged, pull upwards on the rear portion of the magazine 4 until the rifle's magazine catch assembly overrides the magazine locking stud 10. The magazine is now properly inserted into the rifle and the rifle is now ready to be loaded and fired.

This magazine 4 can be constructed with a number of different materials currently available. Some examples are stamped sheet metal and aluminum, or it can be constructed with relative ease by casting or molding high impact polycarbonate resins either transparent or non transparent as is desired and as is the current practice with some manufactures. The design of this magazine lends itself well to using only one type material or by using a combination of materials. Ideally it may be produced as a complete stamped and spot welded sheet metal magazine, or it may be, with the exception of the steel springs, made entirely of high impact polycarbonate resins.

The object of this invention is to provide a high capacity interchangeable magazine that is reliable, durable, and cost effective to all users. To this end high impact transparent polycarbonate resins and steel springs truly would be the best way to produce this magazine.

I claim:

1. A readily detachable, externally loadable, box magazine adapted to replace the original-equipment box magazine of a rifle, the original-equipment magazine having a "clam-shell" configuration utilizing a pair of magazine halves connected at a forward pivot site, the lower half being pivotable to allow the interior portions thereof to be accessed, the rifle having a stock with a vertical through-hole adapted to be covered at its top by a barrel and receiver, covered at its rear underside by a trigger mechanism, and covered at its forward underside by said original-equipment magazine, the original equipment magazine being retained within the stock at its forward end at a fixed attachment site and at its rearward end by a spring-biased retaining latch on the trigger mechanism such that the original-equipment magazine may only be removed from the rifle after prior removal of the lower half of the original-equipment magazine to retain the original-equipment magazine in a closed configuration during use, the readily detachable magazine comprising:

a hollow body formed from front, side and back walls and adapted to house a plurality of cartridges, said hollow body having a top opening allowing cartridges to pass therethrough;

a spring and follower combination disposed within said hollow body to facilitate the extraction of cartridges from within said hollow body during use of the rifle;

an elongated extension section attached at one end to the front wall of said hollow body proximate the top thereof and projecting normally to and forward from said front wall to terminate in a free end having a forward latch projection disposed thereon for readily detachable engagement with the fixed attachment site of the rifle, said extension section substantially covering the underside portion of the through-hole forward of said hollow body when the readily detachable magazine is attached to the rifle; and a rear latch projection attached to the rear wall of said hollow body projecting normally to and rearward therefrom, said rear latch projection being configured for readily detachable engagement with the spring-biased retaining latch of the rifle, whereby the readily detachable magazine may be secured to the rifle by engaging the forward latch projection with the fixed attachment site and the rearward latch projection with the spring-biased retaining latch of the rifle, and the readily detachable magazine may be removed from the rifle by disengaging the forward latch projection from the fined attachment site and the spring-biased retaining latch of the rifle from the rear latch projection of the readily detachable magazine.

2. A readily detachable, externally loadable, box magazine adapted to replace the original-equipment box magazine of a rifle, the original-equipment magazine having a "clam-shell" configuration utilizing a pair of magazine halves connected at a forward pivot site, the lower half being pivotable to allow the interior portions thereof to be accessed, the rifle having a stock with a vertical through-hole adapted to be covered at its top by a barrel and receiver, covered at its rear underside by a trigger mechanism, and covered at its forward underside by said original-equipment magazine, the original equipment magazine being retained within the stock at its forward end at a fixed attachment site and at its rearward end by a spring-biased retaining latch on the trigger mechanism such that the original-equipment magazine may only be removed from the rifle after prior removal of the lower half of the original-equipment magazine to retain the original-equipment magazine in a closed configuration during use, the readily detachable magazine comprising:

a hollow body formed from front, side and back walls and adapted to house a plurality of cartridges, said hollow body having a top opening allowing cartridges to pass therethrough;

a spring and follower combination disposed within said hollow body to facilitate the extraction of cartridges from within said hollow body during use of the rifle;

an elongated extension section attached at one end to the front wall of said hollow body proximate the top thereof and projecting normally to and forward from said front wall to terminate in a free end having a forward latch projection disposed thereon for readily detachable engagement with the fixed attachment site of the rifle, said extension section substantially covering the underside portion of the through-hole forward of said hollow body when the readily detachable magazine is attached to the rifle; and a rear latch projection attached to the rear wall of said hollow body projecting normally to and rearward therefrom, said rear latch projection being configured for readily detachable engagement with the spring-biased retaining latch of the rifle, whereby the readily detachable magazine may be secured to the rifle by engaging the forward latch projection with the fixed attachment site and the rearward latch projection with the spring-biased retaining latch of the rifle, and the readily detachable magazine may be removed from the rifle by disengaging the spring-biased retaining latch of the rifle from the rear latch projection of the readily detachable magazine, and while pivoting the magazine in a forward and downward direction disengaging the forward latch projection from the fixed forward attachment site.

3. An improved magazine for use in a rifle having an internal bolt hold-open device, the rifle normally using a magazine having a mechanism for engaging the bolt hold-open device of the rifle after the last round contained in the magazine has been fired, the improved magazine comprising:

a hollow body formed from front, side and back walls and adapted to house a plurality of cartridges, said hollow body having a top opening allowing cartridges to pass therethrough;

a spring and follower combination disposed within said hollow body to facilitate the extraction of cartridges from within said hollow body during use of the rifle;

an internal bolt stop assembly mounted on a follower body forming part of the spring and follower combination and within the hollow body of the magazine, said internal bolt stop assembly including a bolt stop, a bolt stop spring and a pin, the bolt stop pivotally mounted to the body of the magazine by said pin, the spring urging the bolt-stop outward from the follower body into the path of the riflers internal bolt hold-open device;

as the follower is depressed into the body of the magazine by the loading of the first round, the bolt stop rides on the inside back wall of the magazine hollow body, depressing the bolt stop into the rear face of the follower body and remaining in that position while the magazine remains loaded and disengaging from the rear face of the follower body and being biased by the bolt stop spring into the rifle's bolt hold-open device and activating the device upon the exit of the last round from the magazine thereby causing the rifle's bolt to remain in the open position.

* * * * *